US007081822B2

(12) United States Patent
Leyden et al.

(10) Patent No.: US 7,081,822 B2
(45) Date of Patent: Jul. 25, 2006

(54) SENSING ASSEMBLY FOR ARTICLE TO BE MONITORED

(75) Inventors: Roger Leyden, Willow Springs, IL (US); Terrance Surma, Bloomingdale, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 20 days.

(21) Appl. No.: 10/740,272

(22) Filed: Dec. 18, 2003

(65) Prior Publication Data

US 2005/0134458 A1 Jun. 23, 2005

(51) Int. Cl.
*G08B 21/00* (2006.01)

(52) U.S. Cl. ..... 340/635; 340/568.2; 340/693.5; 340/568.4; 340/652; 340/568.3

(58) Field of Classification Search ..... 340/635, 340/568.2, 693.5, 568.4, 652, 568.3
See application file for complete search history.

(56) References Cited

U.S. PATENT DOCUMENTS

| | | | | |
|---|---|---|---|---|
| 4,233,595 | A | 11/1980 | Landkammer | |
| 4,620,182 | A | 10/1986 | Keifer | |
| 5,124,685 | A * | 6/1992 | Rankin | 340/568.2 |
| 5,146,205 | A * | 9/1992 | Keifer et al. | 340/568.2 |
| 5,172,098 | A | 12/1992 | Leyden et al. | |
| 5,246,183 | A | 9/1993 | Leyden | |
| 5,421,667 | A | 6/1995 | Leyden et al. | |
| 5,552,771 | A | 9/1996 | Leyden et al. | |
| 5,574,430 | A * | 11/1996 | Ott et al. | 340/568.2 |
| 5,870,023 | A | 2/1999 | Jackson | |
| 6,027,277 | A * | 2/2000 | Leyden et al. | 403/291 |
| 6,621,415 | B1 | 9/2003 | Willis | |
| 6,761,579 | B1 * | 7/2004 | Fort et al. | 439/501 |
| 2004/0206138 | A1 | 10/2004 | Murray, Jr. et al. | |
| 2005/0001485 | A1 | 1/2005 | Pail | |

FOREIGN PATENT DOCUMENTS

| | | |
|---|---|---|
| EP | 1168268 | 1/2002 |
| GB | 2044970 | 10/1980 |
| GB | 2161303 | 1/1986 |
| JP | 09330483 | 12/1997 |
| WO | WO99/28580 | 6/1999 |

* cited by examiner

*Primary Examiner*—Tai T. Nguyen
(74) *Attorney, Agent, or Firm*—Wood, Phillips, Katz, Clark & Mortimer

(57) ABSTRACT

A retractable sensing assembly having a housing, a sensor connectable to an article to be monitored, a conductive element operatively connected to the sensor and a mechanical cable. The sensor has a secured state and an unsecured state. The conductive element is selectively extendable from and retractable into the housing. The conductive element includes at least one conductive wire through which the state of the sensor can be detected. The mechanical cable is connected to the sensor and is connectable at an anchoring location so that movement of the sensor is confined by the mechanical cable relative to an anchoring location to which the mechanical cable is connected.

39 Claims, 10 Drawing Sheets

SENSING ASSEMBLY FOR ARTICLE TO BE MONITORED

BACKGROUND OF THE INVENTION

1. Field of the Invention

This invention relates to security systems for monitoring portable articles and, more particularly, to a security system utilizing a sensing assembly with an elongate tether which confines movement of the article within a prescribed range.

2. Background Art

The proliferation of portable, high tech articles has presented unique challenges to their purveyors. In the electronics industry, different technologies continue to evolve, resulting in different types of products and more companies competing for the attention of the consumer. As an example, the technology in the personal digital assistant (PDA) industry is developing at an astounding rate. More and more functional capabilities continue to be incorporated into PDA's, which are becoming the equivalent of hand-held offices. Those interested in purchasing a PDA may find what is purchased now to be obsolete in a matter of mere months.

The trend with this product, as well as others primarily in the electronics industry, has led to the use of elaborate point-of-purchase displays in establishments where these products are sold. Given the cost of these products, and the myriad different capabilities they possess, consumers have demanded a hands on operating trial. To facilitate this, the PDA's are commonly placed on a support system, which may include a shelf or counter. A tether is used to secure each article, with one end thereof suitably attached to the article and the other end to the support system. This allows the potential consumer to pick up, hold, and operate the article in normal fashion within a range dictated by the length of the tether.

Various types of security systems incorporating such a tether have been utilized over the years. In a basic form of security system, a purely mechanical tether is utilized. The mechanical tether has a drawback that it is prone to being severed or pulled off of the article or support system, as a result of which the thief may abscond with the article. An exemplary system with a mechanical tether is shown in U.S. Pat. No. 5,421,667.

To afford additional protection for higher end articles, tether systems utilizing electronic components were developed. An exemplary system is shown in U.S. Pat. No. 5,172,098. Electronic systems have the advantage that they are able to detect the separation of the tether from an article, separation of the tether from the support system, and severance of the tether.

In stores at which a large number of articles are displayed in a relatively compact space, "wire management" becomes a significant problem. The "wires" which define the multiple tethers at a given display tend to become tangled. This problem generally is initiated as potential consumers pick up tethered articles and cross the tether on the article being inspected with one or more tethers on adjacent articles as the article is replaced. Without proper periodic display monitoring and maintenance, which is potentially time consuming, the tangling of the tethers may become significant enough that the articles may not be movable within a reasonable range and, in a worst case, may be effectively unmovable to an extent to allow any meaningful inspection thereof. This may lead to frustration on the part of the consumer that causes him/her to abandon the shopping exercise at one establishment and travel to another.

To address wire management problems in mechanical tether systems, it is known to use a recoiling mechanism to draw the mechanical tether into a housing. The user withdraws the tether to increase its effective length by grasping the article and drawing against a return force on the tether. These mechanical systems have been used for many years, but, while generally affordable, have the limitations described above inherent to purely mechanical systems. One such system is shown in U.S. Pat. No. 5,246,183.

The assignee herein made a very significant advance in the industry by devising a security system that has the ability to retract a conductive cord that is integrated into circuitry associated with electronic components. This represented a tremendous advance in the industry, promoting wire management with more sophisticated and expensive electronic components, and other devices. This system is shown in U.S. Pat. No. Re. 37,590. This system has been highly commercially successful. It has proven to be a reliable theft prevention device and one that makes possible effective wire management at displays.

The one drawback that has been experienced with virtually all electronic systems is that conductive wires utilized to design the required circuitry are made with a gauge and hardness that makes them prone to being severed, either by cutting or through the application of a tensile force which causes either a complete severance or a disruption in circuit continuity. This problem has generally been contended with because these electronic systems will detect such a breach and produce a detectable signal to alert a store operator thereof. However, a thief near an exit door may have escaped from the premises before any action can be taken to recover the article.

Thus, mechanical and electronic systems both have advantages and drawbacks. Mechanical systems can be made with sufficient strength that complicated measures must be taken to defeat them. However, once defeated, a breach may not be detected by a store operator, particularly in the confusion of a high traffic environment. Electronic systems have detection capabilities but lack mechanical strength.

Efforts have been made to integrate mechanical and electronic components into security systems to exploit benefits of each. In one known system, severance of a mechanical tether causes retraction thereof which triggers an electronically operated alarm. Such a system is defeatable by knotting the cable or otherwise preventing its full retraction as would trigger the alarm.

To the knowledge of the inventors herein, no device has been commercially offered that has effectively married mechanical and electronic technology to effectively exploit the benefits of both. As electronic components become more complicated, miniaturized and expensive, the demand for more effective security systems increases. Designers of such systems continue to strive in their design endeavors to develop more effective security systems to meet the security demands that have been placed on the industry by both the nature of the articles and the ever increasing skill of would-be thiefs.

SUMMARY OF THE INVENTION

In one form, the invention is directed to a retractable sensing assembly having a housing, a sensor connectable to an article to be monitored, a conductive element operatively connected to the sensor and a mechanical cable. The sensor has a secured state and an unsecured state. The conductive element is selectively extendable from and retractable into the housing. The conductive element includes at least one conductive wire through which the state of the sensor can be detected. The mechanical cable is connected to the sensor and is connectable at an anchoring location so that movement of the sensor is confined by the mechanical cable relative to an anchoring location to which the mechanical cable is connected.

In one form, the mechanical cable is connected to the housing at the anchoring location.

In one form, a drum assembly is provided in the housing and has at least a first drum that is movable around an axis. The conductive element is attached to the drum assembly and is a) wrapped around the first drum as the first drum moves around the axis in a first direction and b) unwrapped from the first drum as the first drum moves around the axis oppositely to the first direction.

In one form, the first drum is biased for movement around the axis in the first direction. The mechanical cable may be attached to the drum to be selectively extended from and retracted into the housing together with the conductive element.

In one form, the conductive wire and mechanical cable each have a length and are joined together to define a unitary construction over a substantial length of the conductive wire and mechanical cable.

The conductive wire and mechanical cable may be surrounded by a sleeve over a substantial length of the conductive wire and mechanical cable.

The conductive wire and mechanical cable may be connected to the sensor at spaced locations.

The mechanical cable may be connectable to an anchoring location spaced from the housing.

In one form, the mechanical cable is made from a hardened metal material.

The detectable sensing assembly may be provided in combination with an article to be monitored. The sensor in one form is bonded to the article.

The sensor may be attached to the article using a separate fastener.

The retractable sensing assembly may be provided in combination with a processing system electrically connected to the sensor through the conductive element.

In one form, the processing system includes an alarm system. With the sensor in the unsecured state, the alarm system is activated.

In one form, with the alarm system activated, the alarm system causes a detectable signal to be generated.

The alarm system may be activated as an incident of the at least one conductive wire being severed.

The retractable sensor assembly may be provided in combination with a support system to which the housing is attached. The cable is connected to the support system at the anchoring location which is spaced from the housing.

A repositionable element may be provided on the sensor. With the repositionable element in a first position, the sensor is in the secured state. With the repositionable element in a second position, the sensor is an unsecured state.

The retractable sensing assembly may be provided in combination with an article to be monitored and, with the sensor connected to the article, the repositionable element is moved by the article from the first position into the second position.

In one form, the mechanical cable may include joined links.

In one form, the conductive wire is integrated through the processing system into an electrical operating circuit, and the cable is not integrated into the electrical operating system.

In one form, the mechanical cable has a tensile strength that is substantially greater than a tensile strength for the conductive element.

The mechanical cable may have a greater resistance to being cut than the conductive element.

The invention is further directed to the combination of a support system, a portable article, a processing/alarm system mounted on the support system and capable of generating a detectable signal, a conductive element having at least one conductive wire that is electrically connected between the processing/alarm system and the article, and a mechanical cable. The processing/alarm system generates a detectable signal as an incident of either a) the at least one conductive wire being severed and b) the conductive element being separated from the article. The mechanical cable has a length and is connected to the article and to a support system at a first location so that the mechanical cable restricts movement of the article away from the first location to a distance determined by the length of the mechanical cable between the first location and the article.

In one form, the at least one conductive wire has a length. The mechanical cable and conductive wire are joined together and define a unitary construction over a substantial length of the mechanical cable and conductive wire.

The mechanical cable may be made from a hardened metal material.

In one form, the conductive wire and mechanical cable are surrounded by a sleeve over a substantial length of the conductive wire and mechanical cable.

The mechanical cable may be defined by joined links.

In one form, the mechanical cable has a tensile strength that is substantially greater than the tensile strength of the conductive element.

The mechanical cable may have a greater resistance to being cut than does the conductive element.

The combination may further include a housing, with the conductive element selectively extendable from and retractable into the housing.

The mechanical cable may be selectively extended from and retracted into the housing.

DETAILED DESCRIPTION OF THE DRAWINGS

Figure 1:
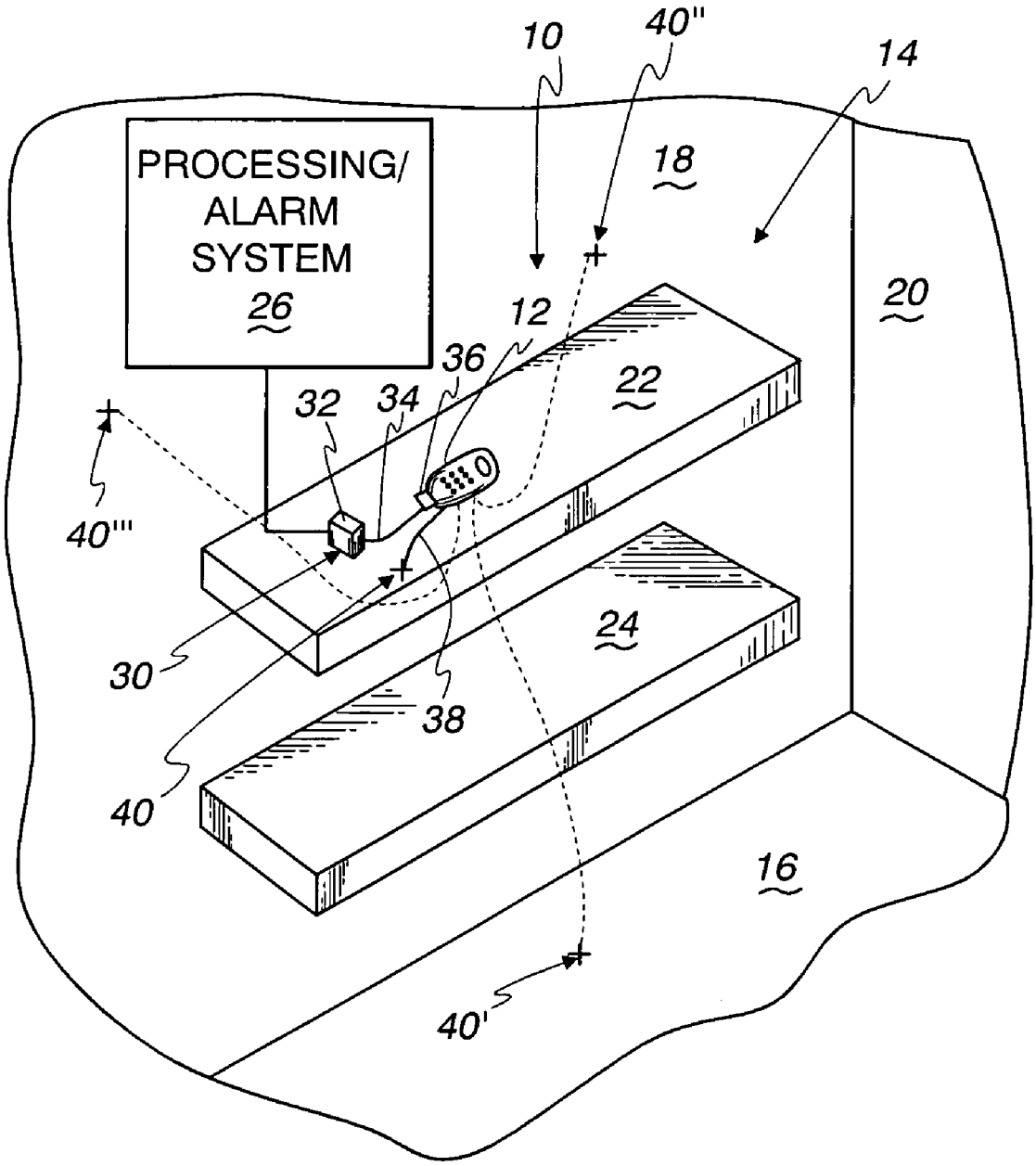
FIG. 1 is a fragmentary, perspective view of one form of security system, according to the present invention, incorporated into a support system and having a retractable sensing assembly with a mechanical cable and a conductive element attached to an article being monitored.

In FIG. 1, one form of security system, according to the present invention, is shown at 10. The security system 10 is designed to monitor a portable article 12, in this case shown as a PDA. It should be understood that the invention is directed to virtually any portable article, and is particularly adaptable to portable electronic devices. The portable article 12 is confined in movement relative to a support system at 14. As used herein, "support system" is intended to define the substantially fixed environment around the portable article 12, to include in this case a floor 16, vertically spaced walls 18, 20, and any shelving or support units placed thereon or attached thereto. In this particular support system 14, two exemplary, vertically spaced shelves 22, 24 are shown mounted upon the wall 18.

The security system shown at 10 in FIG. 1 consists of a processing/alarm system 26, which can be mounted virtually anywhere on the support system 14. As just examples, the processing/alarm system 26 can be mounted on one of the shelves 22, 24, on one of the walls 18, 20, or behind one of the walls 18, 20. The particular configuration of the processing/alarm system 26 is not critical to the present invention. Exemplary processing alarm systems are shown in U.S. Pat. No. 5,172,098 and U.S. Pat. No. Re. 37,590, both of which are incorporated herein by reference.

The processing/alarm system 26 is electrically connected to a retractable sensing assembly at 30. The retractable sensing assembly 30 consists of a housing 32 and a conductive element 34 that is selectively extendable from and retractable into the housing 32 to change the exposed effective length thereof, as hereinafter described. The conductive element 34 is operatively connected to a sensor 36 that is connected to the article 12. The sensor 36 has a secured state and an unsecured state, with the latter resulting with the sensor 36 separated from the article 12. The conductive element 34 has at least one conductive wire through which the state of the sensor 36 can be detected via electrical communication with the processing/alarm system 26. The processing/alarm system 26 can be designed and/or programmed so that upon detecting the unsecured state of the sensor 36 through the conductive wire(s), a detectable signal is generated. The detectable signal may be an audible signal and/or a signal that is visually or otherwise detectable to an individual supervising the security system 10.

The retractable sensing assembly 30 further consists of a mechanical cable 38 that is connected to the portable article 12. The end of the mechanical cable 38 remote from the article 12 is connected at an anchoring location 40 on the support system 14 by any suitable means. In this embodiment, the anchoring location 40 is on the shelf 22. Alternatively, the anchoring location may be on the floor 16 as shown at 40', on one of the walls 18, 20 as shown at 40", on the opposite side of the wall 18 as shown at 40''', or elsewhere.

With this basic structure, the portable article 12 is secured through a combination of both mechanical and electronic means with each of the conductive element 34 and mechanical cable 38 functioning as a "tether" which confines movement of the article 12 as dictated by the length of the "tether". The processing/alarm system 26 may be capable of generating a detectable signal in the event that either the sensor 36 is separated from the portable article 12 or a circuit into which the conductive wire and conductive element is integrated is interrupted by the severance of the wire(s) on the conductive element 34. In the event that a would-be thief either separates the sensor 36 from the portable article 12, or severs the conductive element 34, he/she must additionally contend with the mechanical connection established by the mechanical cable 38 between the article 12 and the support system 14.

The mechanical cable 38 can be fixedly attached to the portable article 12 at a location spaced from the sensor 36 in a permanent or semi-permanent manner. The connection may be made by an adhesive, a fastener, etc. Virtually any means known to those skilled in the art may be used to connect the mechanical cable 38 to the portable article 12.

Figure 2:
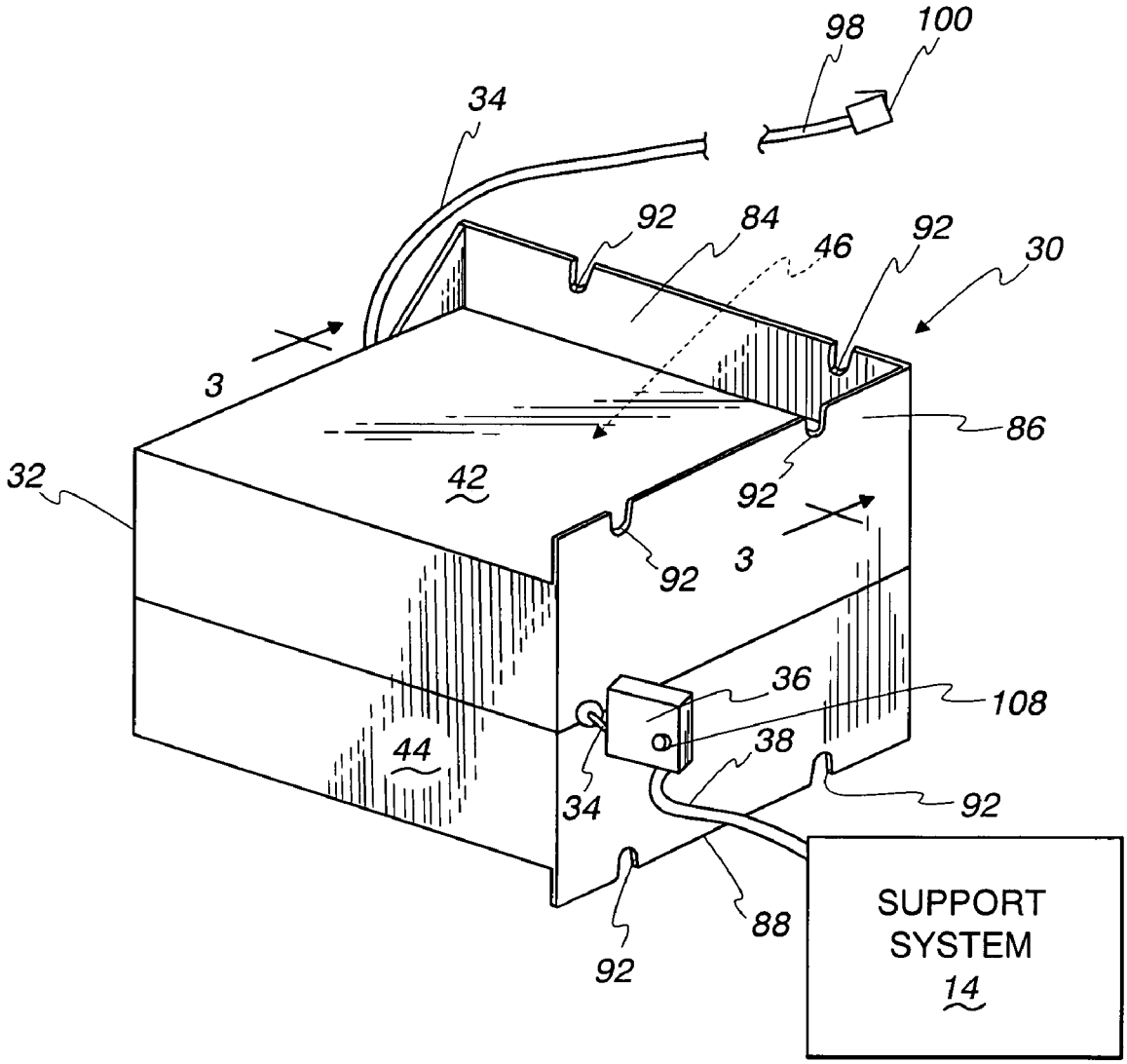
FIG. 2 is an enlarged, perspective view of the retractable sensing assembly in FIG. 1.
Figure 3:
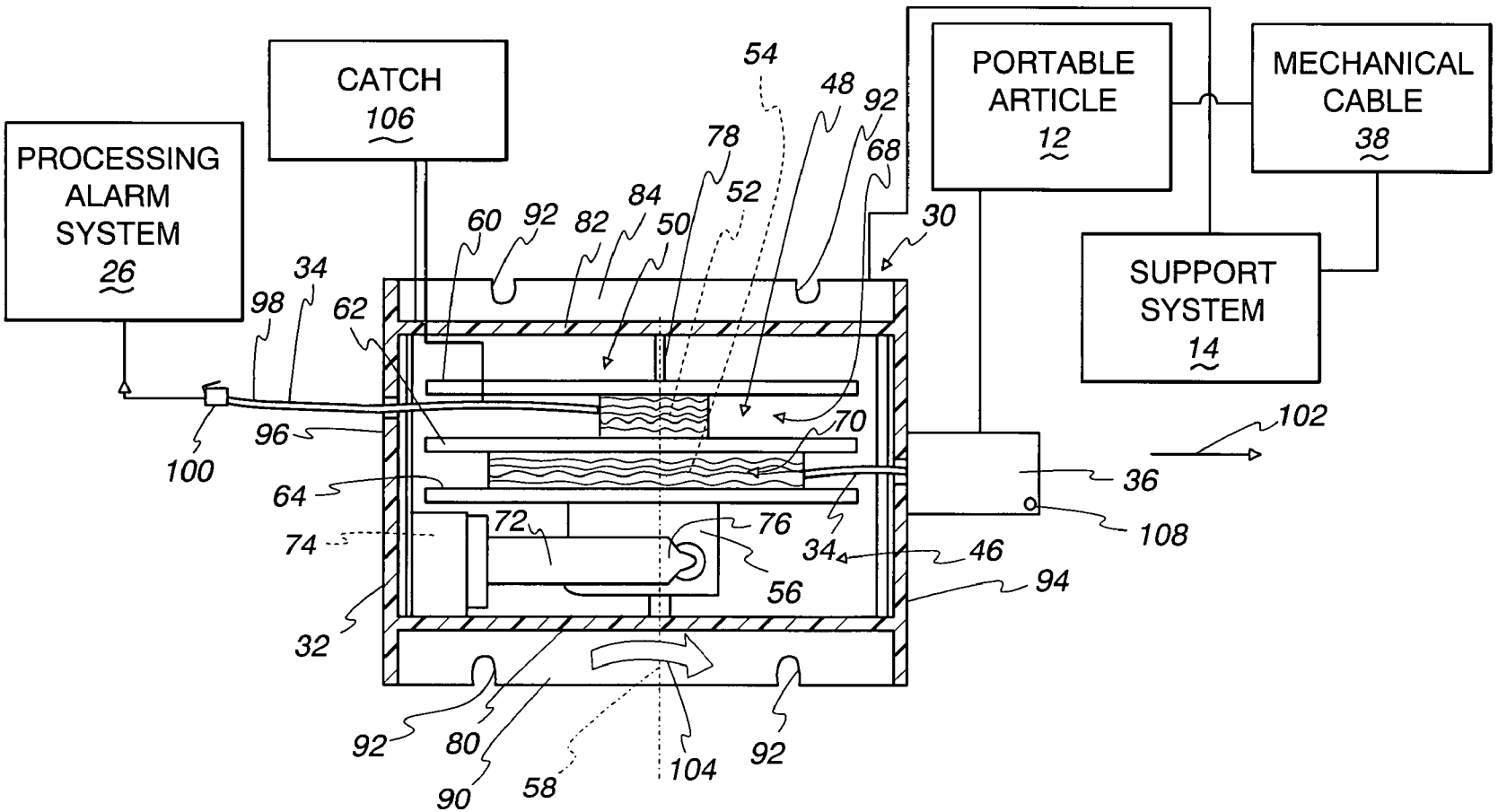
FIG. 3 is a partially schematic representation of the security system in FIG. 1 and with a cross-sectional view of a housing on the retractable sensing assembly taken along line 3—3 of FIG. 2.

Further details of the security system 10, and different embodiments thereof, will now be described. In FIGS. 2 and 3, details of the retractable sensing assembly 30 are shown. The housing 32 consists of joinable housing parts 42, 44 which are combined to define an internal component space 46.

Within the internal component space 46, a retracting mechanism at 48 is provided. The retracting mechanism 48 includes a drum assembly at 50. The drum assembly 50 has three coaxial drums 52, 54, 56, which are rotatable as a unit around an axis 58. The drum assembly 50 includes three axially spaced flanges 60, 62, 64 fixedly attached to the drums 52, 54, 56 to provide a unitary structure that moves around the axis 58. The flanges 60, 62 bound, in conjunction with the drum 52, a first storage space 68 for a supply of the conductive element 34 wrapped around the drum 52. The flanges 62, 64 bound, in conjunction with the drum 54, a second storage space 70 for a supply of the conductive element 34 wrapped around the drum 54. A coil spring 72 resides within a cup-shaped receptacle 74 and has a free end portion 76 which projects from the receptacle 74 and attaches to the drum 56.

The drum assembly 50 is guided in pivoting movement by an axle 78 which may be either fixed to the drum assembly 50 or the housing 32. In the former case, the axle 78 is journalled for rotation with respect to spaced housing walls 80, 82 through which the axle 78 projects. In the latter case, the axle 78 is journalled for rotation in the drum assembly 50.

The housing 32 has mounting flanges 84, 86, 88, 90 that facilitate mounting of the housing 32 to the support system 14. Slots 92 are provided in the flanges 84, 86, 88, 90 to receive suitable fasteners (not shown in FIGS. 1–3).

The conductive element 34 extends continuously from the sensor 36 a) through the housing wall 94 to and around the hub 54, b) to and around the hub 52, and c) through the opposite housing wall 96 to outside of the housing 32. The end 98 of the conductive element 34 projected through the housing wall 96 may have a connector 100, such as a phone plug, thereon, to facilitate electrical connection of the retractable sensing assembly 30 to the processing/alarm system 26. As explained in U.S. Pat. No. Re. 37,590, as the sensor 36 is drawn in the direction of the arrow 102 away from the housing 32, the drum assembly 50 moves in a first direction around the axis 58, as indicated by the arrow 104. This causes the conductive element 34 to be drawn off the wrapped supply thereof on the drum assembly 50 and to simultaneously load the coil spring 72 which is caused to be wrapped around the drum 56. The restoring force in the loaded coil spring 72 normally biases the drum assembly 50 for movement around the axis 58 oppositely to the direction indicated by the arrow 104. This opposite drum assembly rotation causes the conductive element 34 to be retracted into the housing 30 and wrapped around the drum assembly 50. By reason of the different diameters of the drums 52, 54, when the conductive element 34 is withdrawn from the housing 32, the unwinding conductive element 34 forms a loose spiral around the drum 52 and is prevented from extending out of the housing 32 by a catch 106.

With the housing 32 suitably attached to the support system 14, and the conductive element 34 electrically connected to the processing/alarm system 26, the sensor 36 can be attached to the portable article 12, as shown schematically in FIG. 3. The mechanical cable 38 is separately attached to the portable article 12 and to the support system 14 for redundant mechanical connection. In this embodiment, an LED 108 is shown on the sensor 36 and is useable to identify the state of the sensor 36, as described in U.S. Pat. No. 5,172,098.

In FIG. 2, a modification is shown wherein the mechanical cable 38, connected to the support system 14 at a location spaced from the housing 32, is connected to the sensor 36.

Figure 4:
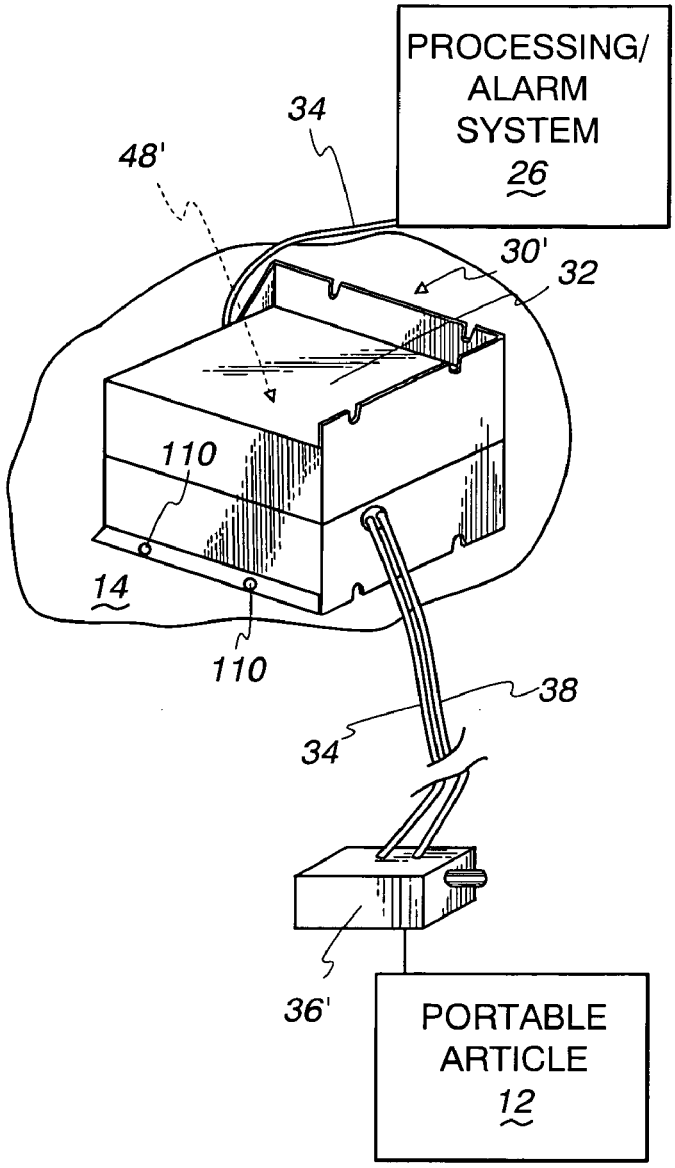
FIG. 4 is a partially schematic representation of a security system as in FIG. 1 and showing a modified form of retractable sensing assembly, according to the invention, wherein the conductive element and mechanical cable are separate and both retractable into a housing.

In FIG. 4, a modified form of a retractable sensing assembly is shown at 30', with the conductive element 34 electrically connected to the processing/alarm system 26. The retractable sensing assembly 30' incorporates the housing 32 which is attached to the support system 14 through suitable fasteners 110.

In this embodiment, the conductive element 34 and mechanical cable 38 are each attached to the sensor 36', as shown in FIG. 3. The sensor 36', in turn, is suitably attached to the portable article 12. However, in this embodiment, both the conductive element 34 and mechanical cable 38 are retracted into the housing 32 through a retracting mechanism 48'.

Figure 5:
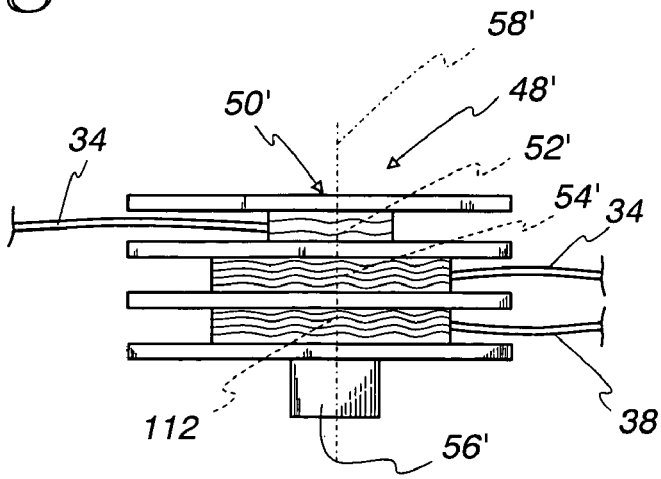
FIG. 5 is a plan view of a drum assembly, within the housing of FIG. 4, to allow retraction of the separate conductive element and mechanical cable.

As shown in FIG. 5, the retracting mechanism 48' consists of a drum assembly 50' having drums 52', 54', 56' corresponding to the drums 52, 54, 56, previously described. An additional drum 112 is incorporated into the drum assembly 50' to accommodate the mechanical cable 38. As the drum assembly 50 moves about the axis 58' in a retracting direction, the mechanical cable 38 is caused to be wound upon the drum 112 simultaneously as the conductive element 34 is wound around the drum 54'. With this arrangement, the anchoring location for the mechanical cable 38 becomes the housing 32, rather than the support system 14.

Figure 6:
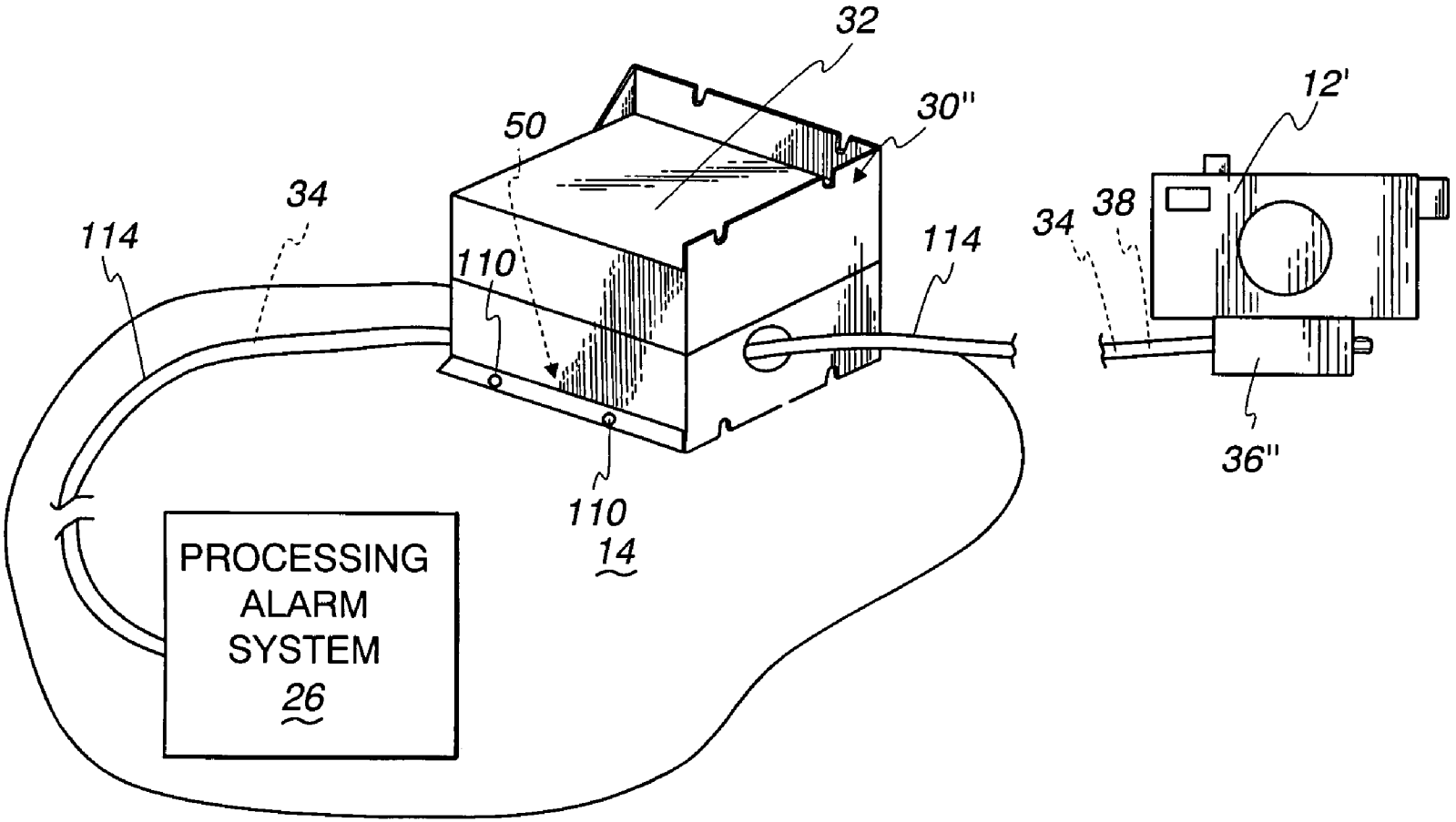
FIG. 6 is a view as in FIG. 4 of another form of retractable sensing assembly, according to the present invention, wherein the conductive element and mechanical cable are united into a single cord.

In FIG. 6, another modified form of retractable sensing assembly, according to the present invention, is shown at 30". The retractable sensing assembly 30" incorporates the housing 32, which is mounted through the fasteners 110 to the support system 14. In this embodiment, the conductive element 34 and mechanical cable 38 are combined to produce a unitary tether/cord 114. The drum assembly 50 is incorporated into the housing 32 to function with the unitary cord 114 in the same manner as it was described to cooperate with the conductive element 34, above. The unitary cord 114 is connected to a sensor 36" attached to an article 12', in this case depicted as a camera. In this embodiment, the conductive element 34 is integrated into the electrical circuitry of the operatively connected retractable sensing assembly 30" and processing/alarm system 26.

Figure 7:
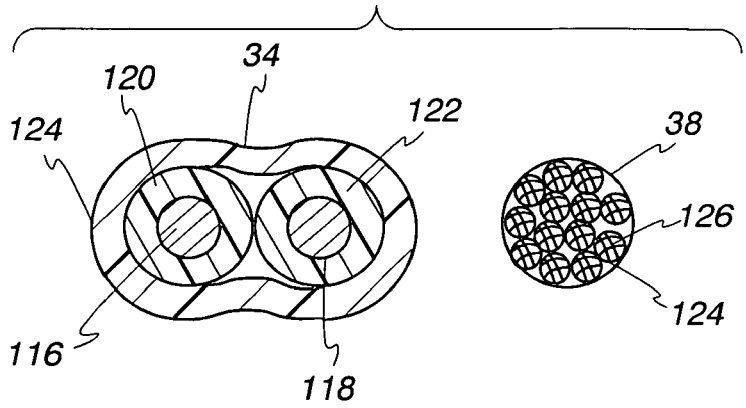
FIG. 7 is an enlarged, sectional view of one form of conductive element and mechanical cable usable in the retractable sensing assemblies shown in FIGS. 1–6.

FIG. 7 depicts one form of each of the mechanical cable 38 and conductive element 34 that can be utilized as with the retractable sensing assembly 30' shown in FIG. 4. In this embodiment, the conductive element 34 has two conductive wires 116, 118 which are utilized to provide the circuitry required to incorporate the desired features for the security system 10. The conductive element 34 may incorporate from one to a relative large number of conductive wires, according to the present invention.

In this embodiment, the conductive wires 116, 118 of the conductive element 34 are encased in insulating layers 120, 122, respectively. The insulating layers 120, 122 are in turn surrounded by a sleeve 124 which unitizes the conductive wires 116, 118 with their respective insulating layers 120, 122.

Figure 8:
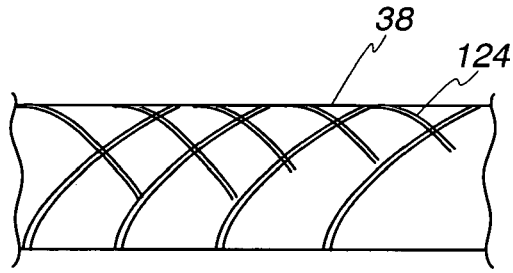
FIG. 8 is an enlarged, fragmentary, side elevation view of the mechanical cable in FIG. 7.

The mechanical cable 38 can be made from a solid material or, as shown in FIGS. 7 and 8, bundles 124 of accumulated fibers 126 that are interwoven such as by controlled spiral wrapping thereof. The mechanical cable 38 may be made from a hardened metal. A suitable construction for the mechanical cable 38 is commonly described as "aircraft cable".

Figure 9:
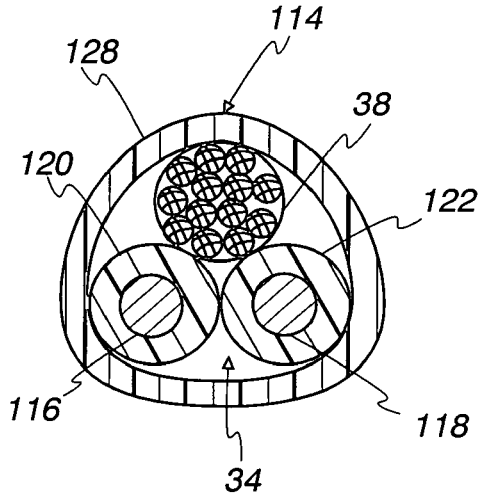
FIG. 9 is an enlarged, cross-sectional view of one form of unitary cord, as shown on the retractable sensing assembly in FIG. 6, including a conductive element and mechanical cable.

In FIG. 9, one form of unitary cord 114, as shown in FIG. 6, incorporates the conductive wires 116, 118 of the conductive element 34, with their respective insulating wires 120, 122, and the mechanical cable 38 in FIGS. 7 and 8. A surrounding sleeve 128 unitizes the mechanical cable 38 and conductive wires 116, 118 with their respective insulating layers 120, 122. The sleeve 128 could be made from a heat shrinkable woven material that positively unites the conductive element 34 and mechanical cable 38 while adding mechanical strength to the unitary cord 114.

Figure 10:
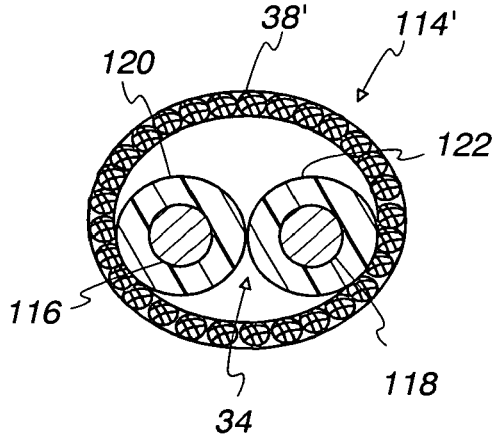
FIG. 10 is a view as in FIG. 9 of a modified form of unitary cord, according to the present invention.

In FIG. 10, a further modified form of unitary cord is shown at 114', incorporating the conductive wires 116, 118 of the conductive element 34, and their respective insulating layers 120, 122. In this embodiment, a mechanical cable 38' surrounds the conductive wires 116, 118 to effect unitization thereof. The mechanical cable 38' may be made in a sleeve form using hardened materials, such as the fibers 126, previously described, which can be strategically formed to provide the desired mechanical strength for the mechanical cable 38'.

Figure 11:
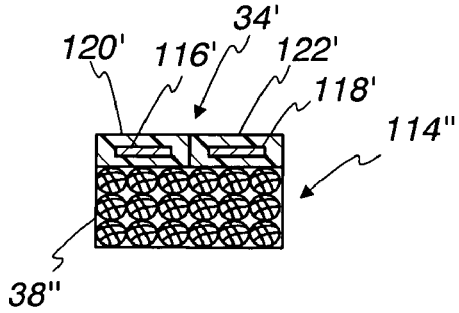
FIG. 11 is a view as in FIGS. 9 and 10 of a further modified form of unitary cord, according to the present invention.

In FIG. 11, a unitary cord 114" is shown consisting of a conductive element 34', with conductive wires 116', 118' having a generally rectangular cross-sectional configuration, with conforming insulating layers 120', 122'. The conductive wires 116', 118', with their respective insulating layers 120', 122', are united with a squared mechanical cable 38" to produce an overall rectangular configuration.

Figure 12:
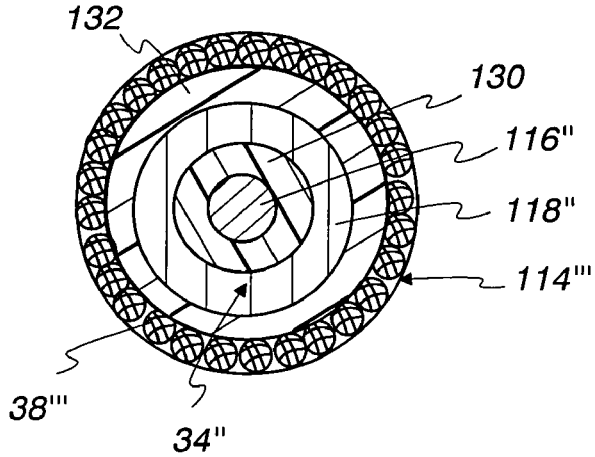
FIG. 12 is a view as in FIGS. 9–11 of a still further modified form of unitary cord, according to the present invention.

As a further alternative, as shown in FIG. 12, a conductive element 34" with conductive wires 116", 118" can be concentrically configured with an insulating layer 130 therebetween and an insulating layer therearound 132. A mechanical cable 38'", in the form of a high strength sleeve, surrounds the insulating layer 132 to define a unitary cord 114'".

The precise nature of the mechanical cable 38, 38', 38", 38'" is not critical to the present invention. What is desirable is that whatever construction or composition is used for the mechanical cable 38, 38', 38", 38'", it have a greater tensile strength and/or resistance to cutting than the associated conductive wires 116, 116', 116", 118, 118', 118". The above examples for each of these components are intended to be exemplary in nature only. There are virtually a limitless number of different configurations for each of the conductive elements 34, 34', 34" and unitary cords 114, 114', 114", 114'" that can be devised to be consistent with the teachings of the present inventive concept.

Figure 13:
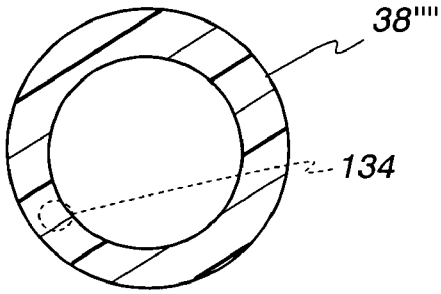
FIG. 13 is an enlarged, cross-sectional view of a modified form of mechanical cable, according to the present invention.

As just one further example, the mechanical cable 38"" could be made from a non-metal material, as shown in FIG. 13. In FIG. 13, the mechanical cable 38"" is intended to surround all, or a substantial amount of the length, of the conductive wires 116, 116', 116", 118, 118', 118" to provide the additional security described above. The non-plastic material defining the mechanical cable 38"" can be selected primarily for its tensile strength. Non-metal materials are currently available that also have a high resistance to cutting. Optionally, one or more metal inserts 134 could be embedded to improve the mechanical properties of the mechanical cable 38"".

Figure 14:
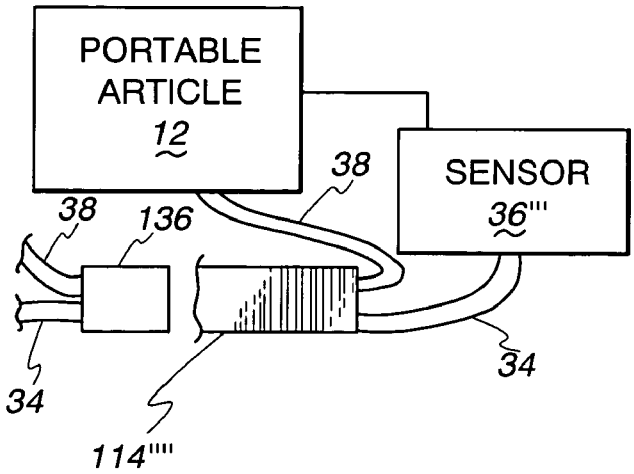
FIG. 14 is a partially schematic representation of a unitary cord, as shown in FIGS. 6 and 9, wherein the separate ends of the conductive elements and mechanical cable are exposed to facilitate connection thereof.

As shown in FIG. 14, a unitary cord 114"" may be made with a surrounding sleeve 136 which extends over a substantial portion of, but not the entire, coextensive length of the exemplary mechanical cable 38 and conductive element 34 shown in that Figure. In this embodiment, the sleeve 136 unites the conductive element 34 and mechanical cable 38 over the majority of the length thereof but leaves the conductive element 34 and mechanical cable 38 exposed at the ends of the unitary cord 114. This facilitates connection of the mechanical cable 38 to the portable article 12 independently of the sensor 36'". At the housing end, the exposed conductive element 34 and mechanical cable 38 can be selectively, separately anchored, i.e. one in the housing 32 and the other elsewhere on the support system 14. The conductive element 34 and mechanical cable 38 may be wrapped either separately, or in a combined manner, on a drum assembly 50, 50'.

Figure 15:
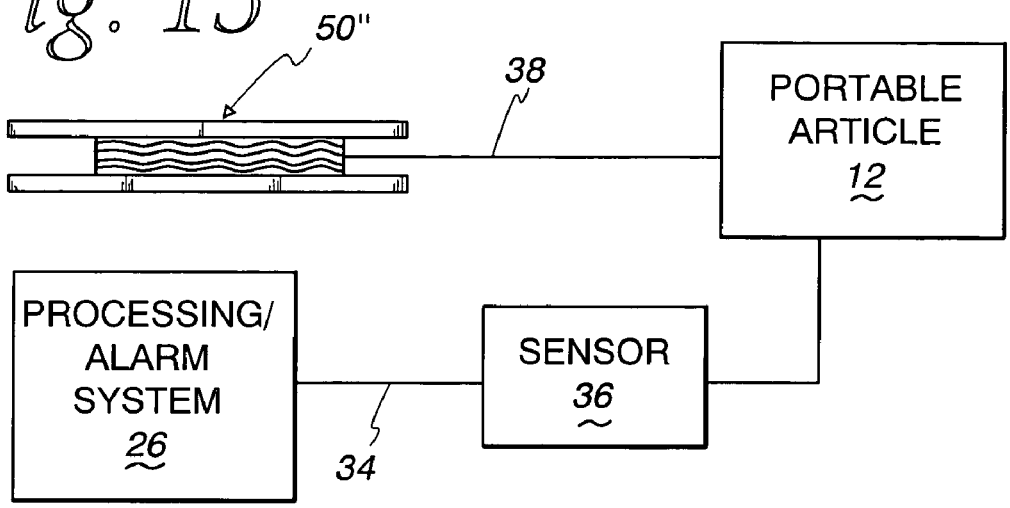
FIG. 15 is a partially schematic representation of a security system, according to the present invention, wherein a mechanical cable is anchored separately from the conductive element and independently retractable.

In a modified form of security system, as shown in FIG. 15, the exemplary sensor 36 is shown attached to the portable article 12 and operatively associated with the processing/alarm system 26. In this embodiment, the mechanical cable 38 is independently selectively extended from and retracted onto a drum assembly 50". The conductive element 34 may be retractable through a separate mechanism or kept in an unretracted state.

Figure 16:
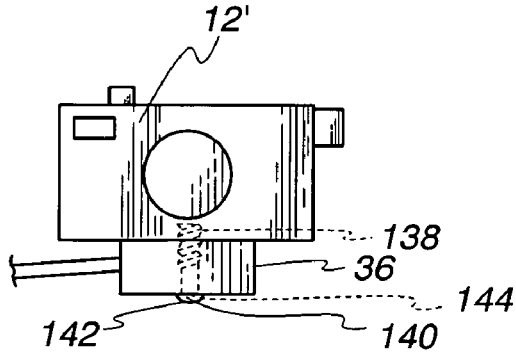
FIG. 16 is a fragmentary, elevation view of a sensing assembly, according to the invention, including a sensor attached to an article utilizing a mechanical fastener.

In FIG. 16, one manner of mounting the exemplary sensor 36 to an article 12' is shown. The article 12' is depicted as a camera which typically has a blind, threaded bore 138 at the bottom thereto to receive a fastener 140 as typically incorporated into a tripod. The fastener 140 has a head 142 which may include a blind receptacle 144 to accept a security tool (not shown) through which the fastener 140 can be rotated about its length to selectively allow tightening and loosening of the fastener 140.

Figure 17:
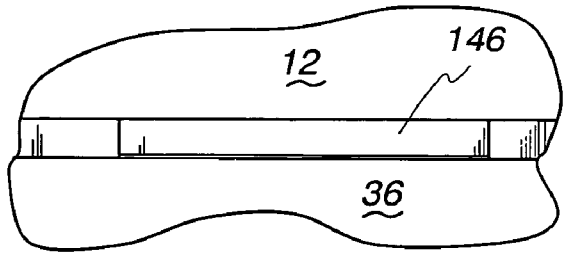
FIG. 17 is a fragmentary, elevation view of another form of connection between a sensor and article, according to the present invention, utilizing an adhesive.

Alternatively, as shown in FIG. 17, the sensor 36 can be directly bonded to the article 12 through an adhesive layer 146.

Figure 18:
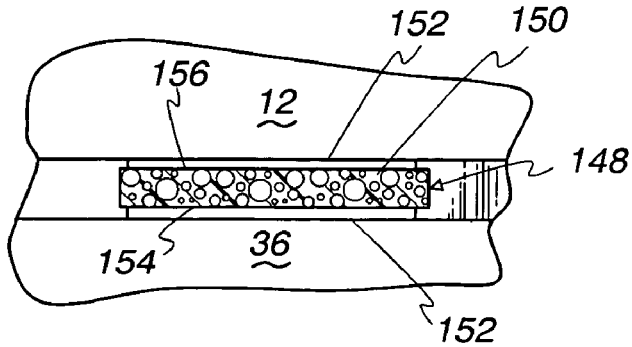
FIG. 18 is a view as in FIG. 17 wherein a multi-layer adhesive tape is used in place of the adhesive.

As a still further alternative, as shown in FIG. 18, a double-sided, composite, adhesive tape 148 can be substituted for the adhesive layer 146. The tape 148 has a cushioned/foam core layer 150 with double-sided adhesive tape layers 152 on opposite sides 154, 156 thereof. The tape layers 152 adhere to the portable article 12 and sensor 36.

Figure 19:
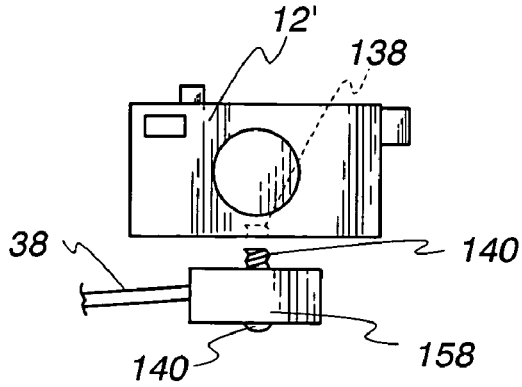
FIG. 19 is a view as in FIG. 16 showing a mechanical connection between a mechanical cable and an article, according to the invention.

As shown in FIG. 19, the exemplary mechanical cable 38 an be connected to the article 12' independently of any sensor, as shown in FIG. 1, through a mounting disc 158, of the type shown in U.S. Pat. No. 5,421,667, which is incorporated herein by reference. Through the mechanical fastener 140, previously described with respect to FIG. 16, the mounting disc 158, which is attached to the mechanical cable 38, can be secured to the camera 12' by threading the fastener 140 into the bore 138.

Figure 20:
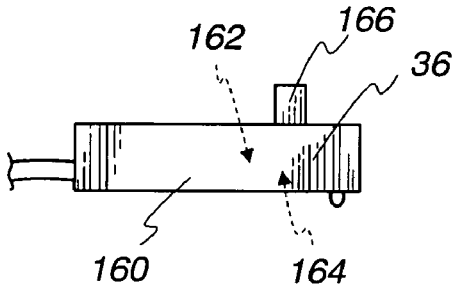
FIG. 20 is an elevation view of one form of sensor, according to the invention, shown in an unsecured state and separated from an article.
Figure 21:
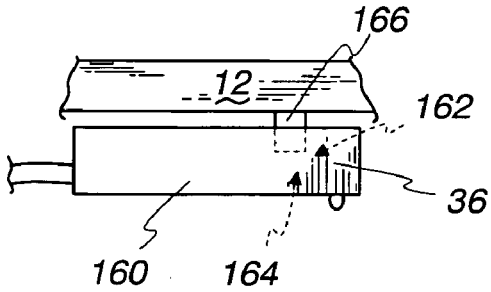
FIG. 21 is a view as in FIG. 20 with the sensor attached to an article and in an armed secured state.

Exemplary operating components on the sensor 36 are shown in FIGS. 20 and 21. The sensor 36 has a housing 160 which defines a receptacle 162 for a switch component 164, of the type shown, for example, in U.S. Pat. No. Re. 37,590. This type of switch component 164 is only intended to be exemplary, as virtually a limitless number of different structures could be utilized consistent with the invention.

The switch component 164 is operable by a repositionable element 166 in the form of a button which can be moved from a first position, as shown in FIG. 20, to a second position, shown in FIG. 21. With the repositionable element 66 in the first position, the sensor 36 is in the unsecured state. By attaching the sensor 36 to the article 12, as shown in FIG. 21, the article 12 causes the repositionable element 166 to be depressed. As this occurs, the sensor 36 is placed in the secured state and the overall system becomes "armed".

Figure 22:
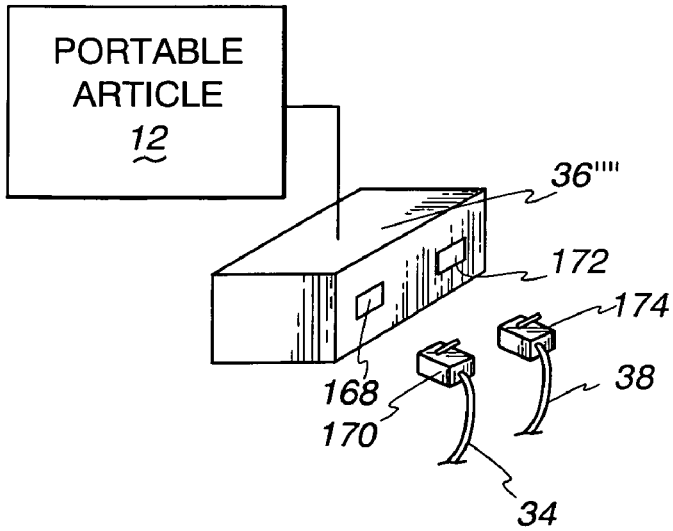
FIG. 22 is a partially schematic, exploded, perspective view of a modified form of sensor, according to the present invention, including cooperating connecting parts on a sensor and each of the conductive element and mechanical cable.

Still other variations of the invention are contemplated. In FIG. 22, a modified form of sensor 36"" is shown suitably attached to the portable article 12. The sensor 36"" has a female connecting part 168 which receives a cooperating male connecting part 170 on the conductive element 34. The connecting parts 168, 170 may be cooperating phone connectors which establish electrical connection between the conductive element 34 and the sensor 36"".

A separate female connecting part 172 is provided to accommodate a male connecting part 174 on the exemplary mechanical cable 38. Phone-type plug connecting parts 172, 174 are known which can be used for this purpose and require a special tool to effect separation. These types of connecting parts are suitable for connecting the mechanical cable 38 securely, yet in such a manner that it could be separated only by an authorized individual.

Figure 23:
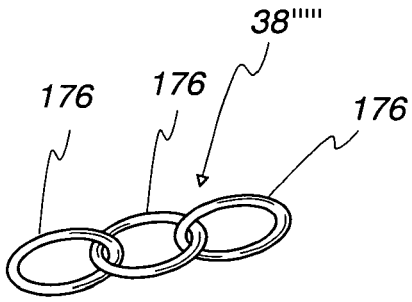
FIG. 23 is a fragmentary, perspective view of a modified form of mechanical cable, according to the present invention, including articulated links.

Another variation of the mechanical cable 38 is shown at 38"" in FIG. 23. The mechanical cable 38"" has interconnected links 176 which produce an articulated length. The strength of the mechanical cable 38"" is dictated by the nature of the material defining the links 176, the gauge of the material defining the links, the size of the links, etc. Other articulated configurations, such as, for example, that on a conventional bike chain, are contemplated.

Figure 24:
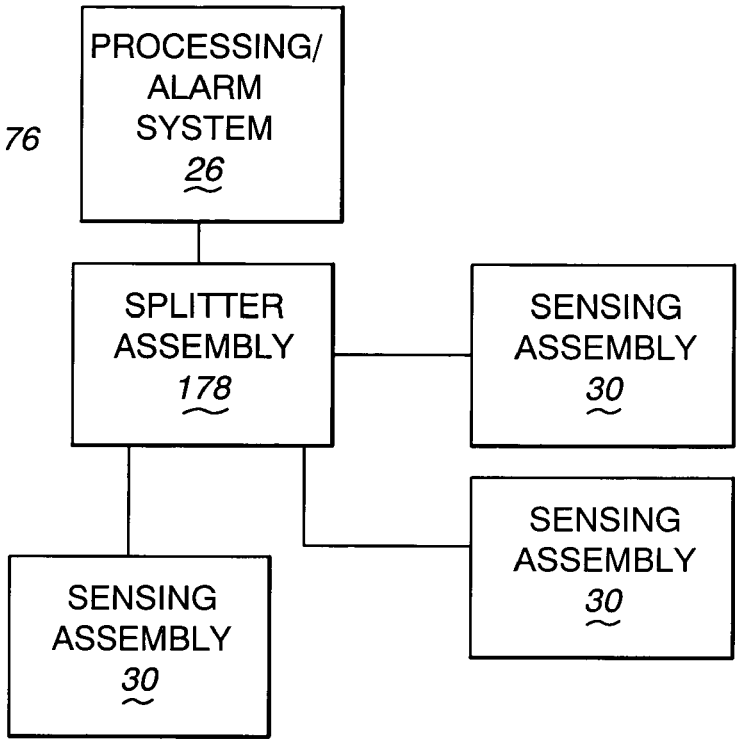
FIG. 24 is a schematic representation of a modified form of security system, according to the present invention, including a processing/alarm system which is operatively connected to a plurality of sensing assemblies through a splitter assembly.

The invention contemplates the ability to use the retractable sensing assemblies 30, 30', 30" either individually or as part of a network. As shown in FIG. 24, a splitter assembly 178, as disclosed in U.S. Pat. No. 5,172,098, can be utilized to accommodate a plurality of the exemplary retractable sensing assemblies 30.

Figure 25:
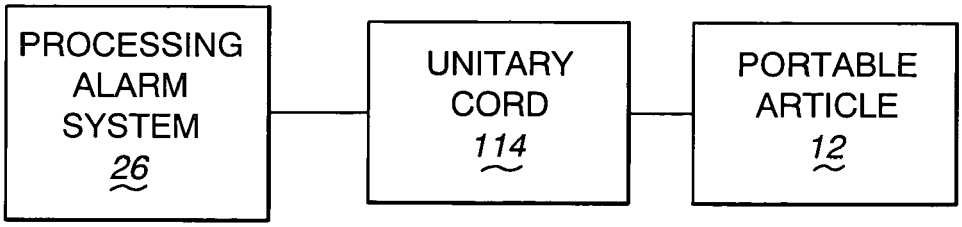
FIG. 25 is a schematic representation of a modified form of security system, according to the present invention, wherein a unitary cord is utilized without any retracting capability.

As shown in FIG. 25, the exemplary unitary cord 114, and variations thereof, as described above and otherwise, can be used to directly interconnect between the portable article 12 and the processing/alarm system 26 without the requirement of any retracting mechanism for any of the components of the unitary cord 114.

Figure 26:
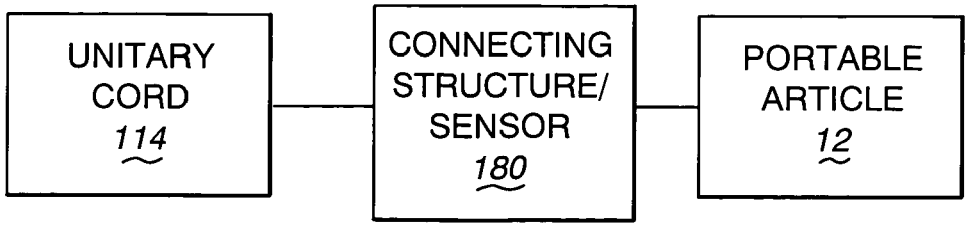
FIG. 26 is a schematic representation of a generic connection between a unitary cord, according to the present invention, and a portable article.

As shown in FIG. 26, the invention contemplates further that other means might be utilized to operatively connect the exemplary unitary cord 114, or individually the separate component parts thereof, to a portable article 12. As shown in FIG. 26, the connecting structure is shown in a generic sense at 180, to encompass the connecting structure shown for the sensors 36, 36', 36", 36'", 36"", and other structures, such as lassos, etc. In a lasso-type connection, the conductive element 34 is, for purposes of the disclosure herein, considered itself to be a sensor connected to the article 12, even though there is no structure fixed directly to the article 12. The connected lasso causes an associated "sensor" to be in a secured state, with the opened lasso being in an unsecured state.

The foregoing disclosure of specific embodiments is intended to be illustrative of the broad concepts comprehended by the invention.

The invention claimed is:

1. A retractable sensing assembly comprising:

a housing;

a sensor connectable to an article to be monitored and having a) a secured state and b) an unsecured state; and an elongated tether having a length, the tether comprising a conductive element operatively connected to the sensor and selectively extendable from and retractable into the housing, the conductive element comprising at least one conductive wire through which the state of the sensor can be detected, the tether further comprising a mechanical cable, the tether connected to the sensor and connectable at an anchoring location so that movement of the sensor is confined by the tether relative to an anchoring location to which the tether is connected, the mechanical cable extending along the length of the tether to resist severance of the tether as might free an article to which the sensor is connected.

2. The retractable sensing assembly according to claim 1 wherein the mechanical cable is connected to the sensor.

3. The retractable sensing assembly according to claim 2 wherein the mechanical cable is connectable to an anchoring location to which the tether is connected.

4. The retractable sensing assembly according to claim 3 wherein the mechanical cable has an end that is connected to the housing which the anchoring location.

5. The retractable sensing assembly according to claim 3 wherein a drum assembly is provided in the housing and comprising at least a first drum that is movable around an axis, the conductive element is attached to the drum assembly and is a) wrapped around the first drum as the first drum moves around the axis in a first direction and b) unwrapped from the first drum as the first drum moves around the axis oppositely to the first direction.

6. The retractable sensing assembly according to claim 5 wherein the first drum is biased for movement around the axis in the first direction.

7. The retractable sensing assembly according to claim 5 wherein the cable is attached to the drum assembly to be selectively extended from and retracted into the housing together with the conductive element.

8. The retractable sensing assembly according to claim 7 wherein the conductive element and mechanical cable each have a length and are joined together to define a unitary construction over a substantial length of the tether.

9. The retractable sensing assembly according to claim 8 wherein the conductive element and mechanical cable are separate elements surrounded by a sleeve over a substantial length of the tether.

10. The retractable sensing assembly according to claim 1 wherein the conductive wire and mechanical cable are connected to the sensor at spaced locations.

11. The retractable sensing assembly according to claim 1 wherein the mechanical cable is connectable to an anchoring location spaced from the housing.

12. The retractable sensing assembly according to claim 1 wherein the mechanical cable is made from a hardened metal material.

13. The retractable sensing assembly according to claim 12 wherein the hardened metal material comprises aircraft cable.

14. The retractable sensing assembly according to claim 1 in combination with an article to be monitored and the sensor is bonded to the article.

15. The retractable sensing assembly according to claim 1 in combination with an article to be monitored and the sensor is attached to the article using a separate fastener.

16. The retractable sensing assembly according to claim 1 in combination with a processing system electrically connected to the sensor through the conductive element.

17. The retractable sensing assembly according to claim 16 wherein the processing system comprises an alarm system and with the sensor in the unsecured state the alarm system is activated.

18. The retractable sensing assembly according to claim 17 wherein with the alarm system activated, the alarm system causes a detectable signal to be generated.

19. The retractable sensing assembly according to claim 17 wherein the alarm system is activated as an incident of the at least one conductive wire being severed.

20. The retractable sensing assembly according to claim 16 wherein the conductive element is integrated through the processing system into an electrical operating circuit and the mechanical cable is not integrated into the electrical operating circuit.

21. The retractable sensing assembly according to claim 1 in combination with a support system to which the housing is attached and the cable is connected to the support system at the anchoring location which is spaced from the housing.

22. The retractable sensing assembly according to claim 1 wherein a repositionable element is provided on the sensor, the repositionable element in a first position with the sensor in the secured state and in a second position with the sensor in the unsecured state.

23. The retractable sensing assembly according to claim 22 in combination with an article to be monitored, and with the sensor connected to the article the repositionable element is moved by the article from the first position into the second position.

24. The retractable sensing assembly according to claim 1 wherein the mechanical cable comprises joined links.

25. The retractable sensing assembly according to claim 1 wherein the mechanical cable has a tensile strength that is substantially greater than a tensile strength for the conductive element.

26. The retractable sensing assembly according to claim 1 wherein the mechanical cable has a greater resistance to being cut than the conductive element.

27. A sensing assembly comprising:

a sensor connectable to an article to be monitored and having a) a secured state and b) an unsecured state; and an elongate tether having a length, the tether comprising a conductive element operatively connected to the sensor, the conductive element having a length, the conductive element comprising at least one conductive were through which the state of the sensor can be detected, the tether further comprising a mechanical cable, the tether connected to the sensor and connectable at an anchoring location so that movement of the sensor is confined by the tether relative to an anchoring location to which the tether is connected, the mechanical cable extending along the length of the tether to resist severance of the tether as might free an article to which the sensor is connected, wherein the mechanical cable and conductive element are surrounded by a sleeve over a substantial length of the tether.

28. The sensing assembly according to claim 27 wherein the mechanical cable is connected to the sensor.

29. The sensing assembly according to claim 27 wherein the mechanical cable is connectable to an anchoring location to which the tether is connectable.

30. The retractable sensing assembly according to claim 29 wherein the mechanical cable is made from a hardened metal material.

31. The retractable sensing assembly according to claim 30 wherein the hardened metal material comprises aircraft cable.

32. The retractable sensing assembly according to claim 27 in combination with an article to be monitored and the sensor is bonded to the article.

33. The retractable sensing assembly according to claim 27 in combination with a processing system electrically connected to the sensor through the conductive element.

34. The retractable sensing assembly according to claim 33 wherein the processing system comprises an alarm system and with the sensor in the unsecured state the alarm system is activated.

35. The retractable sensing assembly according to claim 34 wherein with the alarm system activated, the alarm system causes a detectable signal to be generated.

36. The retractable sensing assembly according to claim 34 wherein the alarm system is activated as an incident of the at least one conductive wire being severed.

37. The retractable sensing assembly according to claim 33 wherein the conductive wire is integrated through the processing system into an electrical operating circuit and the cable is not integrated into the electrical operating circuit.

38. The retractable sensing assembly according to claim 27 wherein the mechanical cable has a tensile strength that is substantially greater than a tensile strength for the conductive element.

39. The retractable sensing assembly according to claim 27 wherein the mechanical cable has a greater resistance to being cut than the conductive element.

* * * * *

UNITED STATES PATENT AND TRADEMARK OFFICE

CERTIFICATE OF CORRECTION

PATENT NO. : 7,081,822 B2
APPLICATION NO. : 10/740272
DATED : July 25, 2006
INVENTOR(S) : Roger Leyden and Terrance Surma It is certified that error appears in the above-identified patent and that said Letters Patent is hereby corrected as shown below:

Column 12, line 19 (claim 4) after "which" insert "defines".

Column 12, line 22 (claim 5) "comprising" should be --comprises--.

Column 13, line 43 (claim 27) "were" should be --wire--

Column 14, line 5 (claim 27) after "sleeve" insert -- that is fixed with respect to the mechanical cable and conductive element--.

Column 14, in line 1 of each of claims 30-39, the word "retractable" should be deleted.

Signed and Sealed this

Fourteenth Day of November, 2006

JON W. DUDAS
*Director of the United States Patent and Trademark Office*

US007081822C1

(12) EX PARTE REEXAMINATION CERTIFICATE (9071st)

United States Patent
Leyden et al.

(10) Number: US 7,081,822 C1
(45) Certificate Issued: Jun. 12, 2012

(54) SENSING ASSEMBLY FOR ARTICLE TO BE MONITORED

(75) Inventors: Roger Leyden, Willow Springs, IL (US); Terrance Surma, Bloomingdale, IL (US)

(73) Assignee: Se-Kure Controls, Inc., Franklin Park, IL (US)

Reexamination Request:
No. 90/009,719, May 7, 2010

Reexamination Certificate for:

| | |
|---|---|
| Patent No.: | **7,081,822** |
| Issued: | **Jul. 25, 2006** |
| Appl. No.: | **10/740,272** |
| Filed: | **Dec. 18, 2003** |

Certificate of Correction issued Nov. 14, 2006.

(51) Int. Cl.
*G08B 21/00* (2006.01)

(52) U.S. Cl. ..... 340/635; 340/568.2; 340/568.3; 340/568.4; 340/652

(58) Field of Classification Search ..... 340/635
See application file for complete search history.

(56) References Cited

To view the complete listing of prior art documents cited during the proceeding for Reexamination Control Number 90/009,719, please refer to the USPTO's public Patent Application Information Retrieval (PAIR) system under the Display References tab.

*Primary Examiner*—Mark Sager

(57) ABSTRACT

A retractable sensing assembly having a housing, a sensor connectable to an article to be monitored, a conductive element operatively connected to the sensor and a mechanical cable. The sensor has a secured state and an unsecured state. The conductive element is selectively extendable from and retractable into the housing. The conductive element includes at least one conductive wire through which the state of the sensor can be detected. The mechanical cable is connected to the sensor and is connectable at an anchoring location so that movement of the sensor is confined by the mechanical cable relative to an anchoring location to which the mechanical cable is connected.

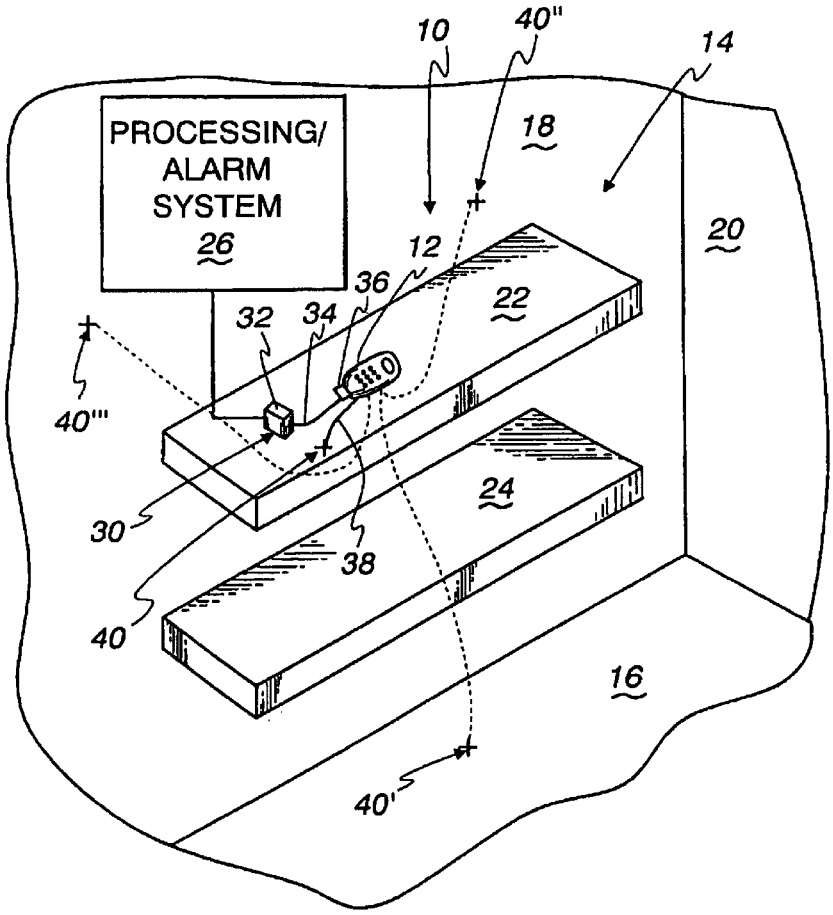

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-26 is confirmed.

Claim 27 is determined to be patentable as amended.

Claims 28-39, dependent on an amended claim, are determined to be patentable.

New claims 40-43 are added and determined to be patentable.

27. A sensing assembly comprising:

a sensor connectable to an article to be monitored and having a) a secured state and b) an unsecured state; and an elongate tether having a length, the tether comprising a conductive element operatively connected to the sensor, the conductive element having a length, the conductive element comprising at least one conductive wire through which the state of the sensor can be detected, the tether further comprising a mechanical cable, the tether connected to the sensor and connectable at an anchoring location so that movement of the sensor is confined by the tether relative to an anchoring location to which the tether is connected, the mechanical cable extending along the length of the tether to resist severance of the tether as might free an article to which the sensor is connected, wherein the mechanical cable and conductive element are surrounded by a sleeve that is fixed with respect to the mechanical cable and conductive element over a substantial length of the tether,

*wherein the mechanical cable has at least one of: a) a tensile strength that is substantially greater than a tensile strength for the conductive element; and b) a greater resistance to being cut than the conductive element.*

*40. A sensing assembly comprising:*

*a sensor connectable to an article to be monitored and having a) a secured state and b) an unsecured state; and*

*an elongate tether having a length,*

*the tether comprising a conductive element operatively connected to the sensor, the conductive element having a length,*

*the conductive element comprising at least one conductive wire through which the state of the sensor can be detected,*

*the tether further comprising a mechanical cable,*

*the tether connected to the sensor and connectable at an anchoring location so that movement of the sensor is confined by the tether relative to an anchoring location to which the tether is connected,*

*the mechanical cable extending along the length of the tether to resist severance of the tether as might free an article to which the sensor is connected,*

*wherein the mechanical cable and conductive element are surrounded by a sleeve over a substantial length of the tether,*

*wherein the mechanical cable has a tensile strength that is substantially greater than a tensile strength for the conductive element.*

*41. A sensing assembly comprising:*

*a sensor connectable to an article to be monitored and having a) a secured state and b) an unsecured state; and*

*an elongated tether having a length,*

*the tether comprising a conductive element operatively connected to the sensor, the conductive element having a length,*

*the conductive element comprising at least one conductive wire through which the state of the sensor can be detected,*

*the tether further comprising a mechanical cable,*

*the tether connected to the sensor and connectable at an anchoring location so that movement of the sensor is confined by the tether relative to an anchoring location to which the tether is connected,*

*the mechanical cable extending along the length of the tether to resist severance of the tether as might free an article to which the sensor is connected,*

*wherein the mechanical cable and conductive element are surrounded by a sleeve over a substantial length of the tether,*

*wherein the mechanical cable is connectable to an anchoring location to which the tether is connectable,*

*wherein the mechanical cable is made from a hardened metal material,*

*wherein the hardened metal material comprises aircraft cable.*

42. *A sensing assembly comprising:*

*a sensor connectable to an article to be monitored and having a) a secured state and b) an unsecured state; and*

*an elongated tether having a length,*

*the tether comprising a conductive element operatively connected to the sensor, the conductive element having a length,*

*the conductive element comprising at least one conductive wire through which the state of the sensor can be detected,*

*the tether further comprising a mechanical cable,*

*the tether connected to the sensor and connectable at an anchoring location so that movement of the sensor is confined by the tether relative to an anchoring location to which the tether is connected,*

*the mechanical cable extending along the length of the tether to resist severance of the tether as might free an article to which the sensor is connected,*

*wherein the mechanical cable and conductive element are surrounded by a sleeve over a substantial length of the tether,*

*wherein the mechanical cable has a greater resistance to being cut than the conductive element.*

*43. The sensing assembly according to claim 27 wherein the mechanical cable has both: a) a tensile strength that is substantially greater than a tensile strength for the conductive element; and b) a greater resistance to being cut than the conductive element.*

* * * * *